US005511700A

United States Patent [19]

Ouno

[11] Patent Number: 5,511,700

[45] Date of Patent: Apr. 30, 1996

[54] TABLE POT FOR LIQUID SEASONING

[76] Inventor: Taiichi Ouno, 5-28, Biwajima 2-chome, Nishi-ku, Nagoya-shi, Aichi-ken, Japan

[21] Appl. No.: 499,060

[22] Filed: Jul. 6, 1995

[30] Foreign Application Priority Data

| | | | |
|---|---|---|---|
| Jul. 18, 1994 | [JP] | Japan | 6-165109 |
| Oct. 7, 1994 | [JP] | Japan | 6-243228 |
| May 24, 1995 | [JP] | Japan | 7-125239 |

[51] Int. Cl.[6] ..... B67D 3/00

[52] U.S. Cl. ..... 222/481.5; 222/545

[58] Field of Search ..... 222/481.5, 482, 222/545, 547, 564

[56] References Cited

U.S. PATENT DOCUMENTS

| | | | |
|---|---|---|---|
| 5,002,209 | 3/1991 | Goodall | 222/481.5 X |
| 5,133,482 | 7/1992 | Burrows et al. | 222/481.5 X |
| 5,228,603 | 7/1993 | Pham et al. | 222/479 |

FOREIGN PATENT DOCUMENTS 5-277024 10/1993 Japan .

*Primary Examiner*—Gregory L. Huson
*Attorney, Agent, or Firm*—Parkhurst, Wendel & Burr

[57] ABSTRACT

A table pot for a liquid seasoning, including a container body having an opening at an upper end thereof, for storing the liquid seasoning therein, and a lid which is attached to the container body so as to close the opening. The lid has a fluid passage and an air inlet formed in an outer peripheral portion thereof such that the fluid passage and the air inlet are located diametrically opposite to each other. An extended air passage having a larger cross sectional area than the air inlet is connected to an inner open end of the air inlet. The air passage extends toward the fluid passage while being inclined downwardly of the lid. The table pot further includes a shielding member located below an opening of the extended air passage remote from the air inlet, so as to interfere with flow of bubbles of air from the opening of the extended air passage into the liquid seasoning.

11 Claims, 11 Drawing Sheets

TABLE POT FOR LIQUID SEASONING

BACKGROUND OF THE INVENTION

1. Field of the Invention

The present invention relates to a table pot or container for a liquid seasoning, and more specifically to an improvement of such a table pot, in which an air inlet for introducing air into the pot is effectively prevented from clogging or closing.

2. Discussion of Related Art

Table pots for storing liquid seasonings, such as soy sauce, Worcester sauce, red pepper oil and drippings, are generally used at home and restaurants. A known example of such table pots includes a container body having an opening at its upper end, and a lid which is threaded on or otherwise attached to the contained body so as to cover the opening. By tilting the table pot, a liquid seasoning contained in the container body is delivered out of the pot, through a fluid passage formed through the lid.

The table pot as described above has an air inlet for introducing air into the container body. This air inlet is formed through a peripheral portion of the lid which is diametrically opposite to the fluid passage, and serves to avoid reduction of the pressure within the container body when the liquid seasoning is delivered through the fluid passage, to thus permit continuous delivering of the liquid seasoning.

However, the liquid seasoning tends to contact the air inlet upon delivering of the seasoning, and remain in the air inlet even after the delivering, due to the surface tension of the liquid, for example. As a result, the air inlet is narrowed or closed as the remaining seasoning solidifies and accumulates in the air inlet, thereby obstructing smooth supply of air into the container body. This results in deteriorated efficiency or easiness in using the table pot. Such table pots, when used at restaurants in particular, need to be frequently checked and cleaned.

In view of the above problem, the inventor of the present invention proposed a table pot for a liquid seasoning as disclosed in JP-A-5-27702. The proposed table pot is provided with an extended air passage which is connected to the inner open end of the air inlet and has a larger cross sectional area than the air inlet. The extended air passage extends from the air inlet toward the fluid passage, with a slight inclination toward the bottom of the container body. When this table pot is tilted to dispense the liquid seasoning, the extended air passage is open downwards in the vertical direction, whereby the air introduced through the air inlet remains in the extended air passage, thus preventing the seasoning from reaching the air inlet.

However, if the table pot having the extended air passage as described above is tilted to a greater extent to dispense the liquid seasoning, the extended air passage is open downwards but obliquely, that is, the air passage is inclined with respect to the vertical direction, whereby the air is less likely to remain in the extended air passage, letting the liquid seasoning enter the air passage. As a result, the liquid seasoning may reach the air inlet, thereby undesirably causing the air inlet to be narrowed or clogged with the seasoning.

SUMMARY OF INVENTION

It is therefore an object of the present invention to provide a table pot for a liquid seasoning, having an air inlet for introducing air into the pot, in which the seasoning is prevented from reaching the air inlet even when the pot is tilted by an excessively large angle, assuring improved efficiency and easiness in using the table pot.

The above object may be accomplished according to the principle of the present invention, which provides a table pot for a liquid seasoning, comprising: a container body having an opening at an upper end thereof, for storing the liquid seasoning therein; a lid which is attached to the container body so as to close the opening, the lid having a fluid passage and an air inlet formed in an outer peripheral portion thereof such that the fluid passage and the air inlet are located diametrically opposite to each other; means for defining an extended air passage which is connected to an inner open end of the air inlet and has a larger cross sectional area than the air inlet, the extended air passage extending toward the fluid passage while being inclined downwardly of the lid; and a shielding member located below an opening of the extended air passage remote from the air inlet, so as to interfere with flow of bubbles of air from the opening of the extended air passage into the liquid seasoning.

In the table pot constructed as described above, the shielding member interferes with flow of bubbles of air introduced from the opening of the extended air passage, so that the bubbles remain around the opening, even when the table pot is tilted by an excessively large angle. Thus, the liquid seasoning is prevented from entering the extended air passage, and attaching to the air inlet, whereby narrowing and clogging of the air inlet can be effectively avoided, assuring improved efficiency and easiness in using the table pot.

In one preferred form of the present invention, the shielding member consists of an outer flange which extends radially outwards from the opening of the extended air passage, and a cover plate which extends upwards and obliquely from a lower peripheral portion of the outer flange toward the fluid passage in the front of the opening. In this case, the shielding member can be easily formed so that bubbles introduced through the extended air passage remain around the opening of the air passage.

In another preferred form of the invention, the shielding member has a through hole formed at a lower portion thereof. When the table pot is returned to its upright position after dispensing the liquid seasoning, this through hole permits the liquid seasoning which has entered the inside of the shielding member to drop down to the lower part of the container body in which the seasoning is stored.

In a further preferred form of the invention, the lid has a top plate having diametrically opposite circumferential portions, and the fluid passage is formed by a tube which extends upwards from one of these circumferential portions of the top plate, while the air inlet is formed by a through hole formed through the other circumferential portion of the top plate.

BRIEF DESCRIPTION OF THE DRAWINGS

The above and optional objects, features and advantages of the present invention will be better understood by reading the following description of a preferred embodiments of the invention, when considered in conjunction with the accompanying drawings, in which.

DETAILED DESCRIPTION OF THE PREFERRED EMBODIMENTS

Figure 1:
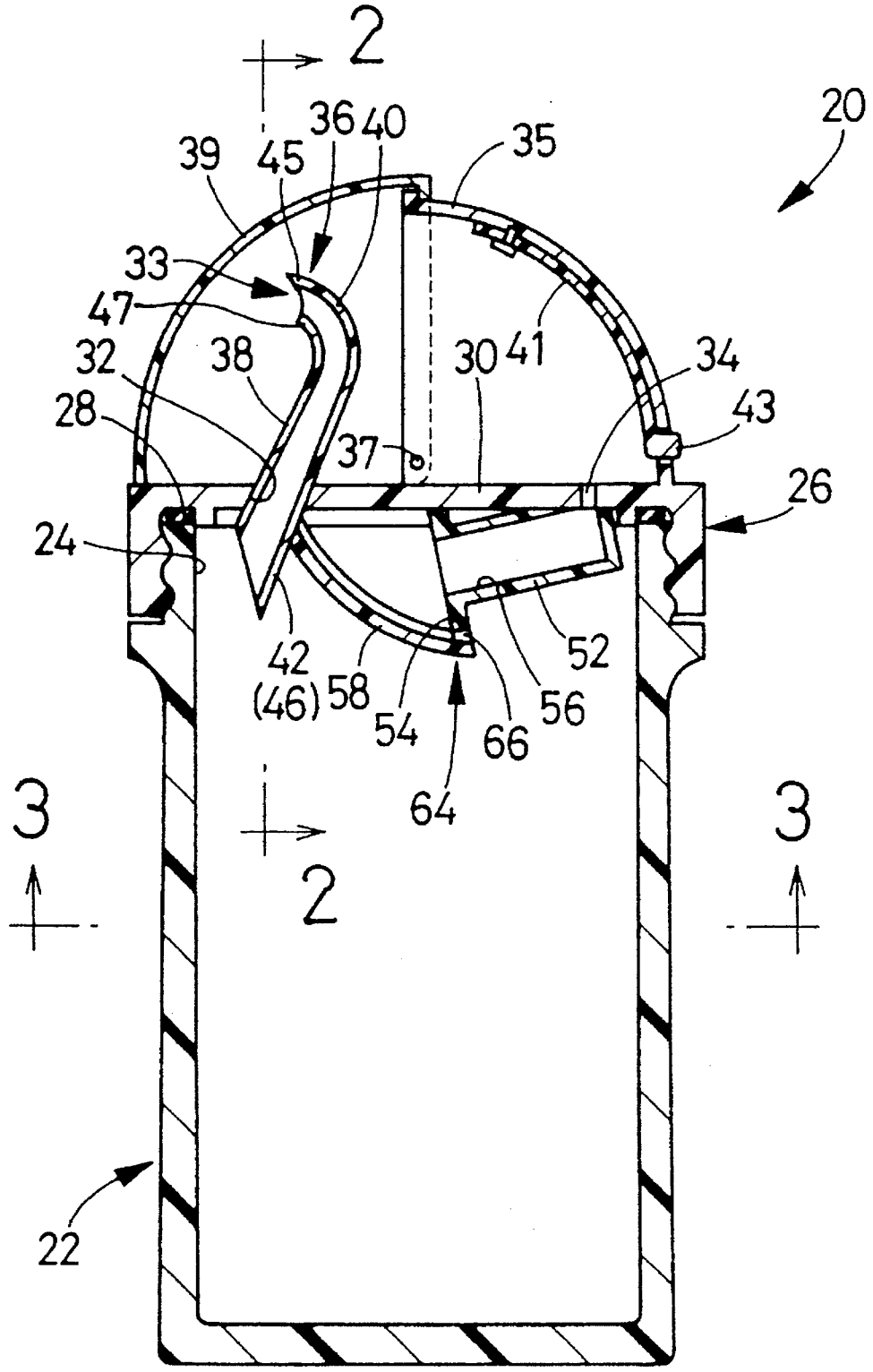
FIG. 1 is an elevational view in axial cross section, showing one embodiment of a table pot for a liquid seasoning of the present invention.

Referring first to FIG. 1 showing one embodiment of the present invention in the form of a table pot 20 for a liquid seasoning, reference numeral 22 denotes a container body having a generally cylindrical shape and closed at one of its opposite axial ends. A suitable amount of liquid seasoning, such as soy sauce or Worcester sauce, can be poured into the container body 22, through an opening 24 formed at the other axial end of the body 22. Thus, the liquid seasoning can be stored in the table pot 20.

The container body 22 has an open axial end portion whose outer circumferential surface is formed with grooves, such that the axial end portion is externally threaded. Lid 26 is screwed on the threaded axial end portion of the container body 22, so as to close the opening 24 of the body 22. The lid 26 has a reversed, shallow cup-like shape.

Seal ring 28 is interposed between the lid 26 and the opposed end face of the container body 22. With the seal ring 28 gripped under pressure by and between the lid 26 and the container body 22, the liquid seasoning stored in the pot 20 is prevented from leaking through mutually engaging portions of the lid 26 and the container body 22. The lid 26 has a mounting hole 32 and an air inlet hole 34 formed through an outer peripheral portion of a top plate 30 thereof, such that the holes 32, 34 are located diametrically opposite to each other. The air inlet hole 34 has a smaller diameter than the mounting hole 32. Tube 36 is fixedly inserted through the mounting hole 32 so as to provide a fluid passage through which the liquid seasoning flows from the container body 22. The tube 36 has a spout 33 at its upper open end, through which the liquid seasoning is delivered out of the table pot 20.

Stationary cover 35 having a generally half-dome shape is fixedly attached to the top surface of the lid 26, such that substantially one half of the lid 26 including the air inlet hole 34 is covered by the cover 35. The stationary cover 35 has a pair of pivot pins 37, 37 provided adjacent to its opening, at its opposite lower end portions. Further, movable cover 39 having a generally half-dome shape with a larger radius of curvature than the stationary cover 35 is attached to the stationary cover 35 through the pivot pins 37, 37, such that the cover 39 is pivotable about the pins 37 over an angle of about 90°.

Figure 4:
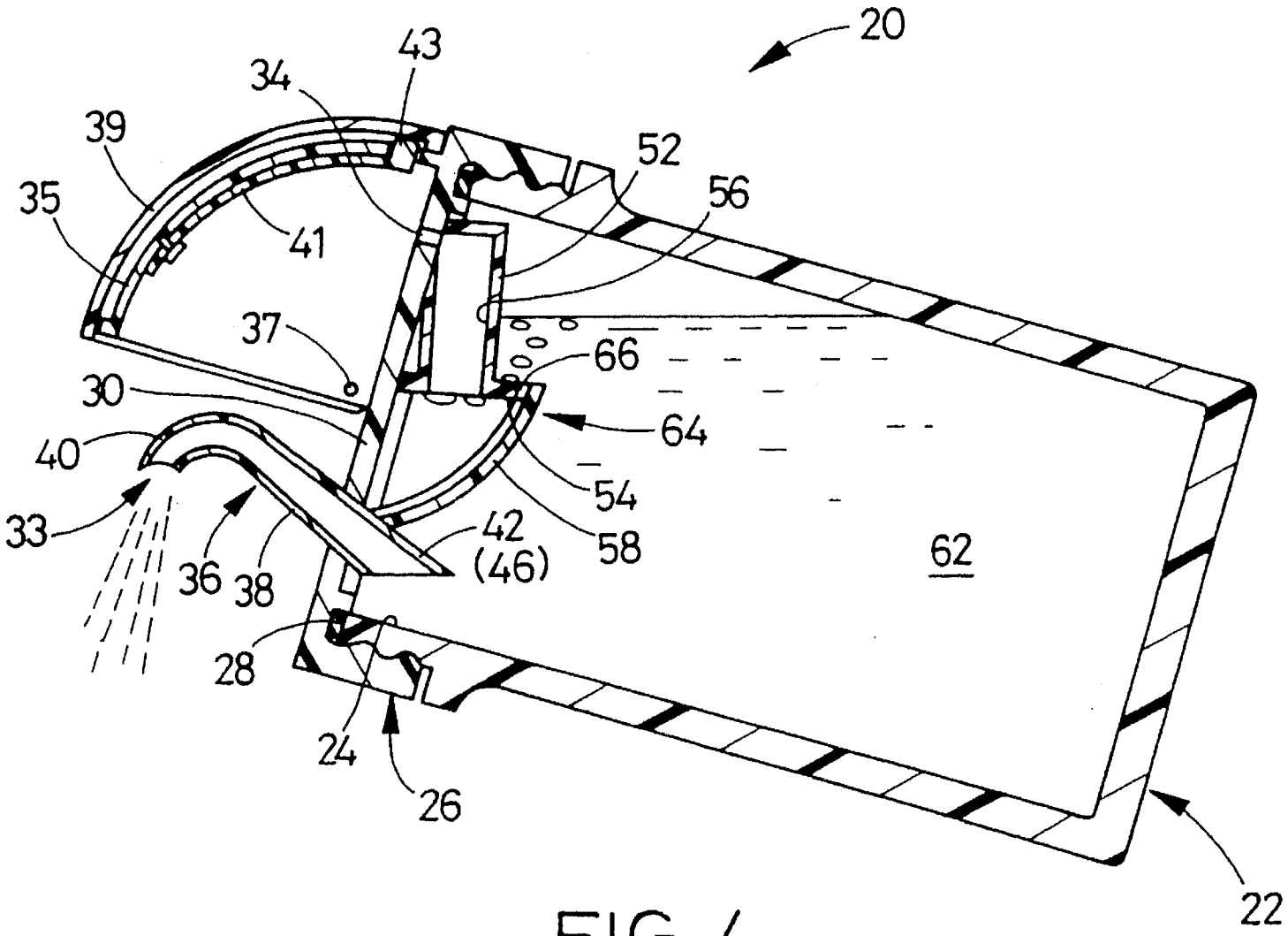
FIG. 4 is an axial cross sectional view showing a state of the table pot of FIG. 1 when it is in use.

When the movable cover 39 is placed in its closed position as shown in FIG. 1, the opening of the stationary cover 35 is covered by the movable cover 39, and these covers 35, 39 cooperate to form a dome-shaped cover for covering the air inlet hole 34, and the exposed part of the tube 36 which includes the spout 33. When the movable cover 39 is then pivoted 90° about the pivot pins 37, and thus placed in its open position, the movable cover 39 is superposed on the outer surface of the stationary cover 35, and the tube 36 having the spout 33 is exposed externally, as shown in FIG. 4. The stationary cover 35 is provided with a boss 43, which protrudes outwards from the lower end portion of the cover 35, under a biasing force of a biasing plate 41. Due to engagement with the boss 43, the movable cover 39 is kept in the open position, that is, is located radially outwardly of the stationary cover 35, and is prevented from closing even when the table pot 20 is inclined or tilted.

The tube 36 mounted in the mounting hole 32 of the lid 26 includes a straight tubular portion 38, and a curved portion 40 which has an arcuate shape and is formed integrally with the straight tubular portion 38. The axial end portion of the tube 36 on the side of the straight tubular portion 38 is fluid-tightly fixed to the inner wall of the mounting hole 32. Thus, the straight tubular portion 38 protrudes upwards from the lid 26, such that the portion 38 is inclined a suitable angle toward the center of the lid 26. The curved portion 40 is curved toward the outer periphery of the lid 26, that is, extends radially outwards from the protruding end of the straight tubular portion 38, such that the spout 33 formed at the upper end of of the tube 36 is open substantially in the horizontal direction.

In the instant embodiment, the spout 33 formed at the upper end of the tube 36 has a concave opening as viewed in the direction of flow of the liquid seasoning from the container body 22. The concave opening of the spout 33 is defined by an internally curved or concave end face of the curved portion 40 of the tube 36. The spout 33 includes an upper end 45 and a lower end 47 between which the concave end face is formed. As shown in FIG. 1, the upper end 45 of the spout 33 protrudes a larger distance than the lower end 47, in the direction in which the liquid seasoning is delivered out of the table pot 20.

Figure 2:
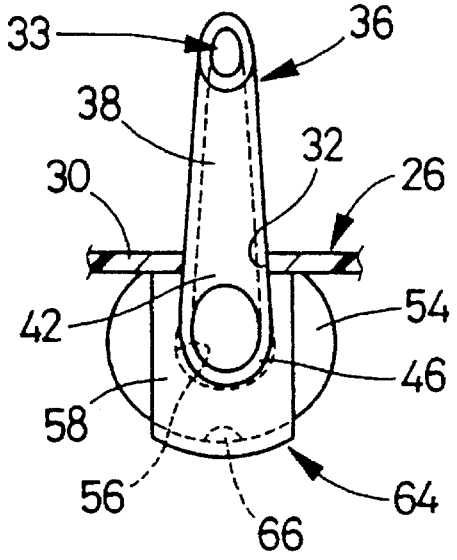
FIG. 2 is a cross sectional view taken along line 2—2 of FIG. 1.

In the instant embodiment, the inside diameter of the straight tubular portion 38 of the tube 36 is larger than that of the open end portion of the curved portion 40, and also gradually increases toward the lower end of the portion 38. That is, the straight tubular portion 38 is tapered off, into the narrowed open end portion of the curved portion 40, as shown in FIG. 2.

The tube 36 further includes an extended portion 42 which protrudes from the lid 26 into the container body 26. The extended portion 42 extends continuously from the lower axial end of the straight tubular portion 38 remote from the curved portion 40, and protrudes downwards such that the portion 42 is inclined radially outwards, that is, toward the outer periphery of the lid 26. The extended portion 42 has an open end portion which is cut in a substantially vertical plane, as seen in FIG. 1. That is, the cut face formed at the lower end of the extended portion 42 is not perpendicular to the axis of the portion 42, and is partially defined by a prolonged wall portion 46 located on the side of the center of the lid 26, which protrudes downwards from the lower axial end of the tube 36.

As described above, the straight tubular portion 38 of the tube 36, which is mounted on the lid 26, is inclined toward the center of the lid 26, and is tapered such that the inside diameter of the straight tubular portion 38 is larger than that of the curved portion 40. When the table pot 20 is erected after dispensing the liquid seasoning, therefore, a portion of the liquid seasoning remaining in the curved portion 40 is subjected to a relatively large suction force, which results from gravity acting on a portion of the seasoning remaining in the straight tubular portion 38. Consequently, the liquid seasoning is effectively cut off at the opening of the spout 33 formed by the curved portion 40 of the tube 36.

The extended portion 42 is formed as described above to extend continuously from the lower axial end of the straight tubular portion 38, and the prolonged wall portion 46 protrudes further into the container body 22. After dispensing of the liquid seasoning, therefore, a portion of the seasoning which reversely flows from the spout 33 toward the container body 22 is gathered at the prolonged wall portion 46, through the extended portion 42, and then drips down into the container body 22. Thus, the liquid seasoning is also effectively cut off or drained at the inner open end of the tube 36 or extended portion 42.

As described above, the upper end 45 of the spout 33 is formed to protrude a larger distance than the lower end 47, in the direction in which the liquid seasoning is delivered out of the table pot 20. Therefore, the upper end 45 has a larger area of contact with the liquid seasoning which flows into the spout 33, as compared with the lower end 47. This permits the tube 36 to effectively function as a siphon after delivering or dispensing the liquid seasoning, whereby the seasoning can be effectively cut off at the spout 33. Consequently, the liquid seasoning does not spill from the spout 33, thereby eliminating conventional problems, such as contamination of the table pot 20 or its surroundings, due to the liquid seasoning spilling from the spout 33.

Further, the opening of the spout 33 is defined by the internally curved or concave end face of the tube 36, as viewed in the direction of flow of the liquid seasoning. This permits the tube 36 to more effectively siphon the liquid seasoning after delivering it, whereby the seasoning can be more effectively cut off at the spout 33 with higher stability.

Figure 3:
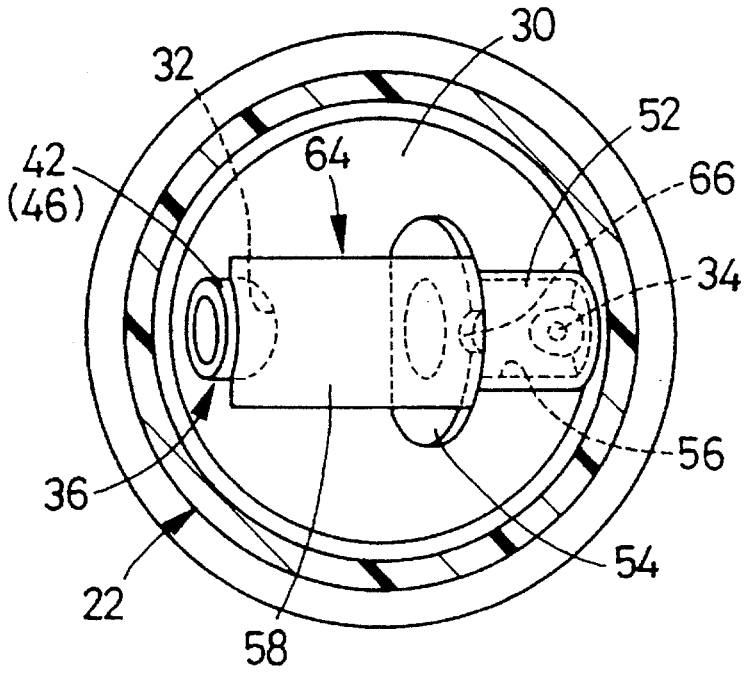
FIG. 3 is a cross sectional view taken along line 3—3 of FIG. 1.

At the diametrically opposite portion of the lid 26 in which the air inlet hole 34 is formed, a cylindrical body 52 is secured to the inner surface of the lid 26, as shown in FIG. 3, such that the cylindrical body 52 communicates with the air inlet hole 34.

The cylindrical body 52 has a generally cylindrical shape and is closed at one of its opposite axial ends. A bottom portion of the cylindrical body 52 is obliquely cut off, to remove a part of its cylindrical wall and an adjacent part of its bottom wall, such that the resulting cut face reaches an inner bore of the cylindrical body 52. The cylindrical body 52 is bonded at the cut face to the inner surface of the lid 26, by an adhesive or fusion-bonding, for example, such that the cylindrical body 52, which is located in the container body 22, extends in a substantially radial direction of the lid 26, and is open toward the mounting hole 32 or tube 36. As shown in FIG. 1, the cylindrical body 52 is inclined with respect to the lid 26, by an angle corresponding to that of inclination of the cut face, such that the inner bore 56 has an opening which is located at a lower level than the bottom wall of the cylindrical body 52. In this condition, the cut face of the container body 52 is fluid-tightly fixed to the lid 26, such that the inner bore 56 communicates with the air inlet hole 34 formed through the lid 26. In the present embodiment, the inner bore 56 of the cylindrical body 52 provides an extended air passage for permitting flow of an air into the container body 22.

The angle of inclination of the inner bore 56 (cylindrical body 52) is not limited to any specific value, but may be suitable determined so that the inner bore 56 is open downwards in a substantially vertical direction, when the table pot 20 is tilted or inclined for dispensing the liquid seasoning. The inclination angle of the inner bore 56 is also determined depending on the kind and viscosity of the liquid seasoning contained in the table pot 20, so that the liquid seasoning, which has inadvertently entered the inner bore 56 upon dispensing thereof, can be readily drained when the table pot 20 is returned to its upright position. That is, the liquid seasoning in the inner bore 56 is required to readily flow down along the cylindrical body 52, and drop into the bottom part of the container body 22, due to gravity acting on the liquid seasoning, while the table pot 20 is being erected.

The diameter of the inner bore 56 of the cylindrical body 52 is determined to be sufficiently larger than that of the air inlet hole 34, so that the liquid seasoning attached to the inner wall of the cylindrical body 52 does not close or clog the inner bore 56 due to the surface tension thereof, for example.

With the cylindrical body 52 secured to the lid 26 in the manner as described above, the air inlet hole 34 is held in communication with the inside of the container body 22, through the inner bore 56 of the cylindrical body 52. Thus, an ambient air is introduced into the table pot 20, through the air inlet hole 34 and the inner bore 56 of the cylindrical body 52, when the liquid seasoning is delivered out of the table pot 20.

The cylindrical body 52 is formed at its opening with an outer flange 54 which extends radially outwards, that is, in a direction substantially perpendicular to the axis of the body 52. The upper peripheral portion of the outer flange 54 is cut off straight, so that the flange 54 is bonded at the cut face thus formed to the inner surface of the lid 26.

Cover plate 58 having a spherically curved, rectangular shape is provided in the front of the opening of the cylindrical body 52, such that the cover plate 58 is opposed to the cylindrical body 52 with a suitable spacing therebetween. The cover plate 58 is bonded at its lower longitudinal end portion to the lower peripheral portion of the outer flange 54, and at its upper longitudinal end portion to adjacent parts of the extended portion 42 of the tube 36 and the inner surface of the lid 26. That is, the cover plate 58 is disposed between the lower peripheral portion of the outer flange 54 and the inner surface of the lid 26 adjacent to the extended portion 42 of the tube 36. Thus, the opening of the cylindrical body 52 is covered or surrounded by the outer flange 54 and the cover plate 58, which are located below and in the front of the opening, with a suitable spacing between the opening and the cover plate 58. In the present embodiment, therefore, the outer flange 54 and the cover plate 58 constitute a shielding member 64 which is located downstream of the opening of the inner bore 56 of the cylindrical body 52 as an extended air passage, for shielding or covering the opening with a suitable spacing therebetween.

The outer flange 54 of the shielding member 64 has a semicircular notch formed through a radially middle part of its lower peripheral portion which is bonded to the cover plate 58. This notch provides a through hole 66 which extends through bonded portions of the outer flange 54 and the cover plate 58.

When the table pot 20 constructed as described above is tilted so as to dispense or deliver out a liquid seasoning 62 contained therein, through the spout 33, as shown in FIG. 4, the opening of the inner bore 56 of the cylindrical body 52 is directed downwards in a substantially vertical direction, and air is introduced into the container body 22 through the inner bore 56, whereby the liquid seasoning 62 is prevented from entering the inner bore 56 and contacting the air inlet hole 34. This can avoid conventional problems, such as narrowing or closing of the air inlet hole 34, caused by the liquid seasoning 62 attached to the air inlet hole 34.

Figure 5:
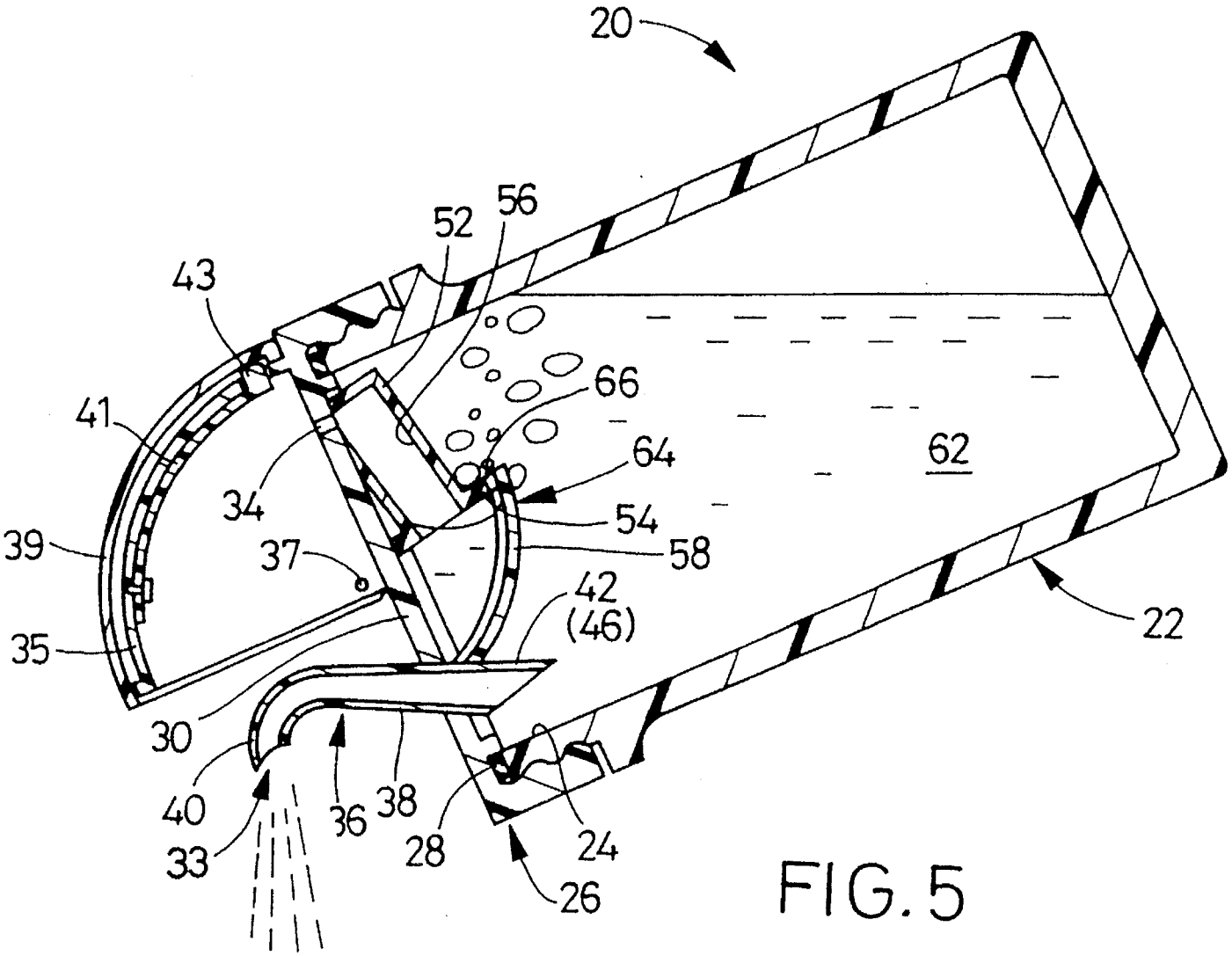
FIG. 5 is an axial cross sectional view showing another state of the table pot of FIG. 1 when it is in use.
Figure 6:
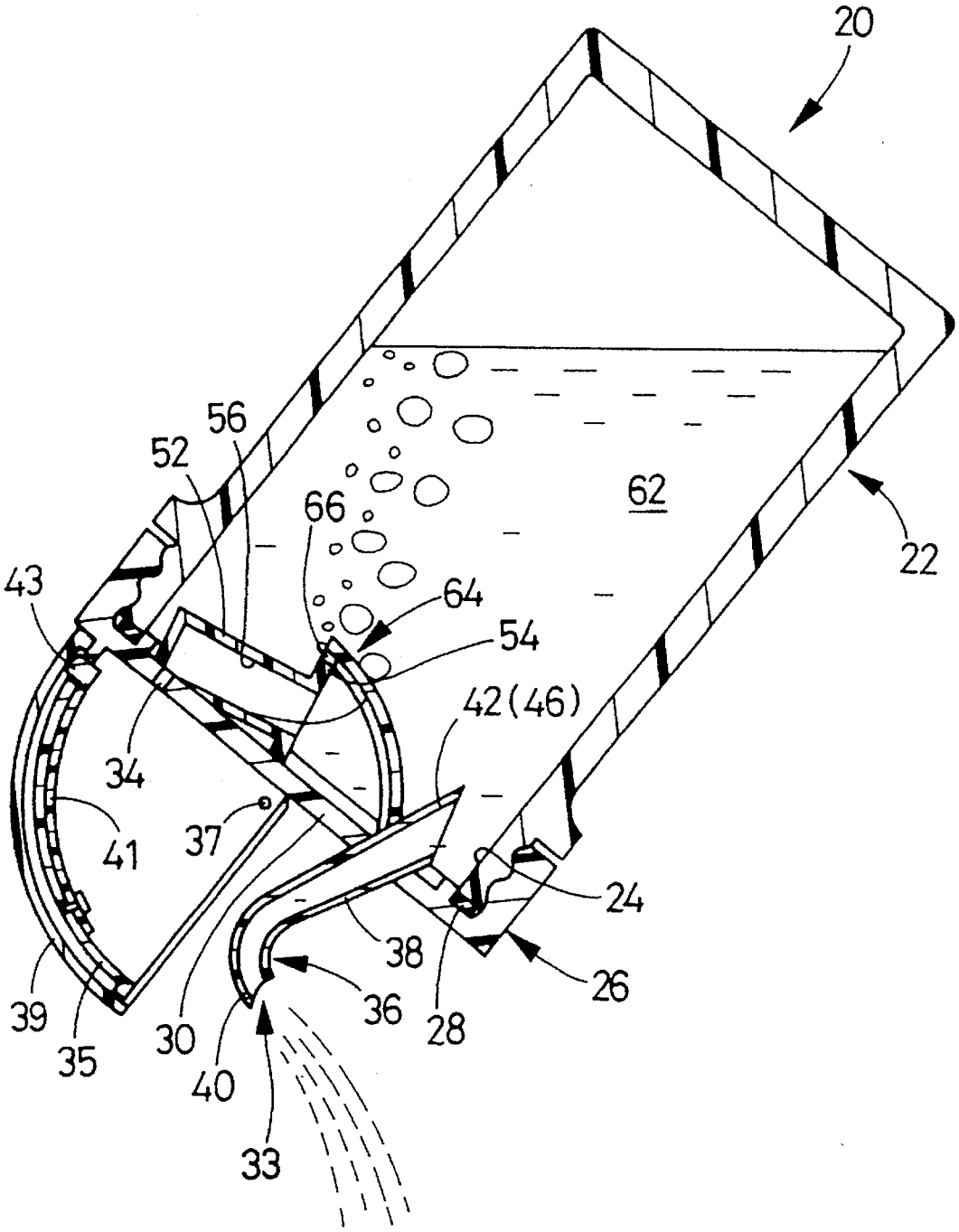
FIG. 6 is an axial cross sectional view showing a further state of the table pot of FIG. 1 when it is in use.

When the table pot 20 is tilted to such a large extent that the cylindrical body 52 is inclined with respect to the vertical direction, and the opening of the inner bore 56 of the cylindrical body 42 is directed downwards but obliquely, as shown in FIG. 5 and FIG. 6, the shielding member 64 is located upwardly and in the front of the opening of the inner bore 56, and the air in the form of bubbles, which have been introduced from the opening of the inner bore 56 into the liquid seasoning 62, is prevented from rising due to the presence of the shielding member 64. As a result, the air is caused to pass around the shielding member 64 and rise from the opposite longitudinal sides of the member 64, while leaving a suitable amount of bubbles within a portion of the liquid seasoning 62 between the shielding member 64 and the opening of the inner bore 56. In this particular embodiment, the shielding member 64 consists of the cover plate 58 in the form of a spherically curved planar body, and the outer flange 54 that is formed with a suitable width over the entire circumference of the inner bore 56 of the cylindrical body 52. This structure ensures the bubbles remaining around the opening of the inner bore 56 of the cylindrical body 52.

As described above, the bubbles flowing into the liquid seasoning 62 through the inner bore 56 of the cylindrical body 52 are likely to be stopped by the shielding member 64 and remain around the opening of the inner bore 56, without immediately going up within the seasoning. Accordingly, even when the table pot 20 is tilted so much that the inner bore 56 is inclined with respect to the vertical direction, the air introduced through the air inlet hole 34 advantageously remains within the inner bore 56, and the liquid seasoning 62 is effectively prevented from entering the inner bore 56. Consequently, the liquid seasoning 62 is prevented from contacting the air inlet hole 34, without causing the above-described problems, such as narrowing or closing of the air inlet hole 34, which are caused by attachment of the liquid seasoning to the hole 34.

The shielding member 64 is located below the opening of the inner bore 56 of the cylindrical body 52. Therefore, the liquid seasoning 62 contained in the table pot 20 is prevented from entering the inner bore 56 of the cylindrical body 52, even when the table pot 20 is erected after dispensing the liquid seasoning, causing spatters of the liquid seasoning from the lower portion of the container body 22.

In the present embodiment, the through hole 66 is formed through the mutually bonded portions of the outer flange 54 and the cover plate 58, which are located at the lowest position of the shielding member 64. When the table pot 20 is erected after dispensing the liquid seasoning, therefore, the liquid seasoning 62 which has entered the inside of the shielding member 64 can readily drain through the through hole 66, into the container body 22. Thus, the liquid seasoning 62 which has entered the inside of the shielding member 64 is prevented from flowing into the inner bore 56 of the cylindrical body 52, or remaining and accumulating in the inner lower portion of the shielding member 64. The through hole 66 also functions to adjust the amount of the air remaining within the shielding member 64, when the table pot 20 is tilted to dispense the liquid seasoning 62.

The curvature, width and other features of the shielding member 64, and the spacing between the shielding member 64 and the opening of the inner bore 56 of the cylindrical body 52 are determined, taking account of the viscosity of the liquid seasoning 62 to be contained in the table pot 20, for example, so that the liquid seasoning 62 does not enter the inner bore 56 of the cylindrical body 52 and bubbles can remain around the opening of the inner bore 56, even when the table pot 20 is tilted by an excessively large angle.

The inner bore 56 of the cylindrical body 52 has a sufficiently larger diameter than the air inlet hole 34, and the cylindrical body 52 is inclined with respect to the lid 26 such that the opening of the inner bore 56 is located at a lower level or height than the bottom wall of the cylindrical body 52. Therefore, the liquid seasoning hardly reaches the air inlet hole 34 even if the seasoning enters the inner bore 56. Further, the liquid seasoning entering the inner bore 56 can be readily drained, without causing closing of the inner bore 56 and other problems.

In the table pot 20 of the present embodiment, the tube 36 is formed with the prolonged wall portion 46 which protrudes into the container body 22, so that the liquid seasoning can be easily cut off at the inner open end of the tube 36 which is exposed to the inside of the container body 22. This effectively avoids narrowing or clogging of the tube 36. Thus, the present table pot 20 can be used with increased ease and efficiency, without suffering from narrowing or clogging of the tube 36 as well as the air inlet hole 34 as described above.

Referring next to FIGS. 9–17, there will be described another embodiment of the present invention, which is different from the first embodiment only in the construction of covers attached to the upper surface of the lid 26, for covering the air inlet hole 34 and the exposed part of the tube 36 which includes the spout 33.

Figure 9:
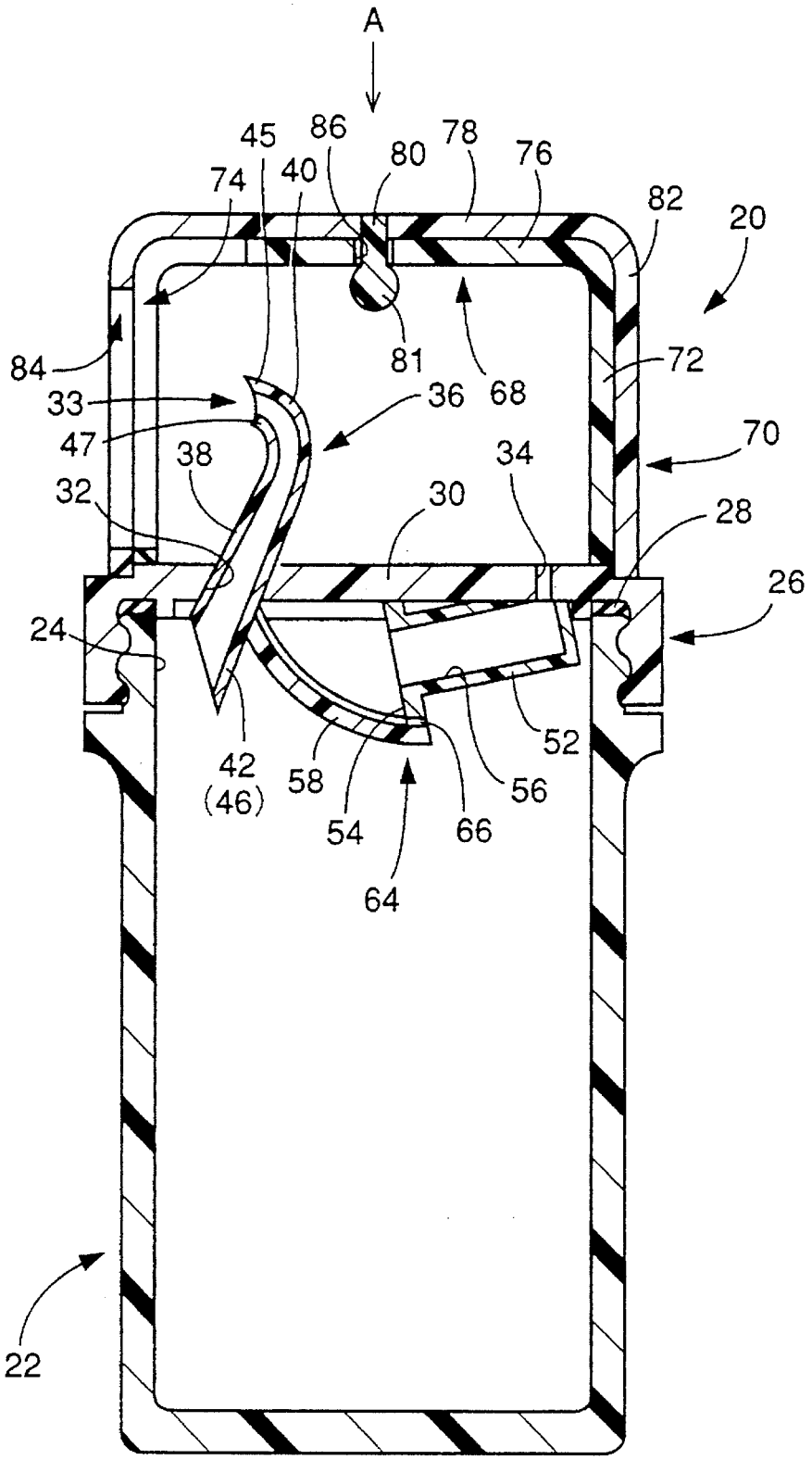
FIG. 9 is an elevational view in axial cross section, showing another embodiment of a table pot for a liquid seasoning of the present invention.

As shown in FIG. 9, a stationary cover 68 is fixed on the upper surface of the lid 26, and a movable cover 70 is disposed so as to cover the outer surface of the stationary cover 68.

More specifically, the stationary cover 68 having a generally cylindrical shape includes a cylindrical portion 72, and a bottom wall 76 formed at one axial end thereof. The cover 68 has an inner window 74 formed through the thickness of the cylindrical portion 72.

Figure 10:
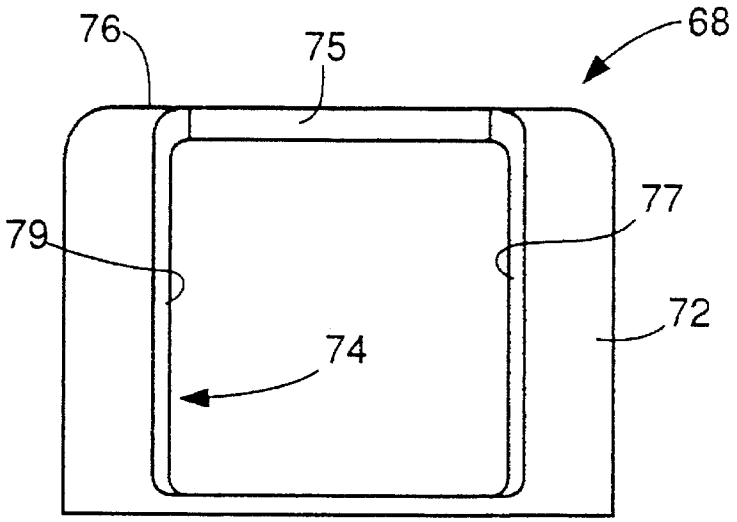
FIG. 10 is a front view showing one example of a stationary cover provided on the table pot of FIG. 9.
Figure 11:
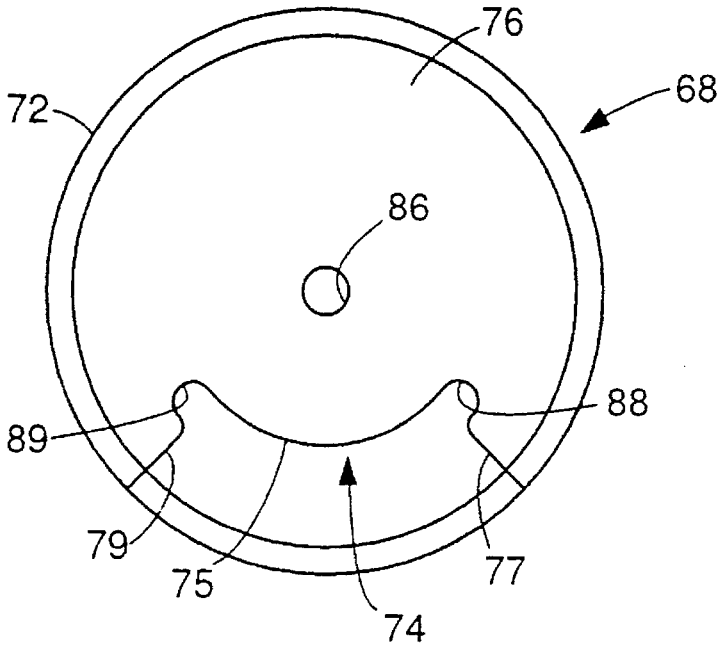
FIG. 11 is a plan view showing the stationary cover of FIG. 10.
Figure 12:
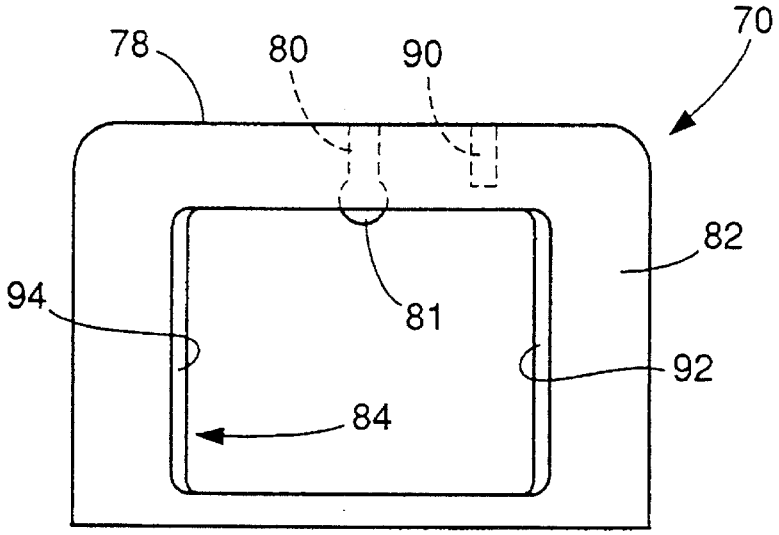
FIG. 12 is a front view showing one example of a movable cover provided on the table pot of FIG. 9.

As shown in FIGS. 10 and 11, the inner window 74 having a generally rectangular shape is formed by removing about one fourth of the cylindrical portion 72 of the stationary cover 68, and an outer peripheral portion of the bottom wall 76 which extends continuously from the removed part of the cylindrical portion 72. The thus removed outer peripheral portion is defined by a circumferential edge 75 and opposite radial edges 77 and 79 of the bottom wall 76. At radially inner ends of the radial edges 77, 79, there are formed respective recesses 88, 89 which extend from the opposite ends of the circumferential edge 75 in the circumferential direction of the bottom wall 76.

The movable cover 70 is a generally cylindrical member having a slightly larger size than the stationary cover 68. This movable cover 70 includes a cylindrical portion 82, and a bottom wall 78 formed at one axial end thereof. Rotary pin 80 is provided at the center of the bottom wall 78, such that the pin 80 protrudes a suitable distance from the inner surface of the bottom wall 78. The rotary pin 80 is formed at its distal end with a ball-like stopper 81, which has an outer diameter slightly larger than the diameter of a through hole 86 formed through the bottom wall 76 of the stationary cover 68. Outer window 84 having a generally rectangular shape is formed through the thickness of the cylindrical portion 82 of the movable cover 70, by removing about one fourth of the cylindrical portion 82.

Figure 13:
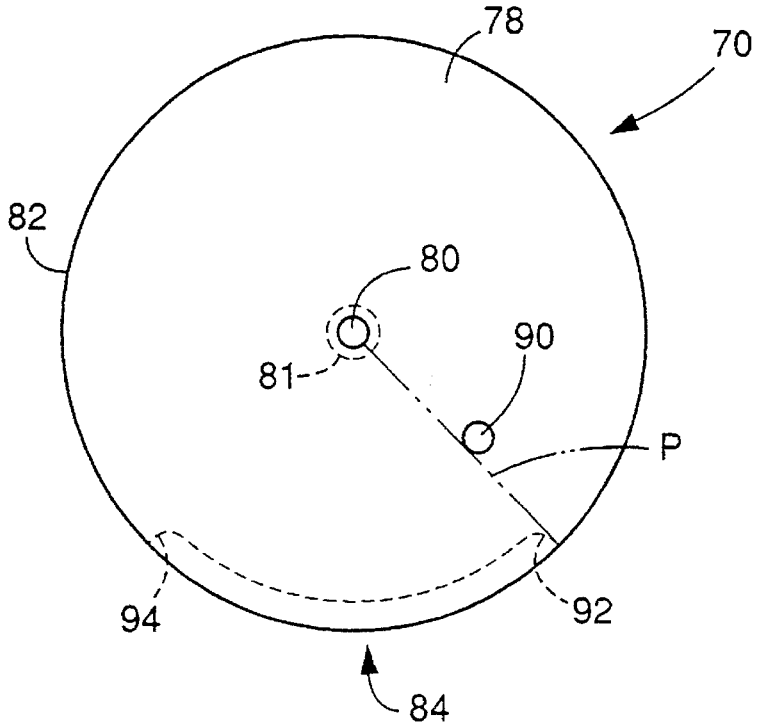
FIG. 13 is a plan view showing the movable cover of FIG. 12.

The movable cover 70 is provided with a stick-like engaging pin 90 which protrudes downwards from a radially intermediate portion of the inner surface of the bottom wall 78. As shown in FIG. 13, this engaging pin 90 is located on a two-dot chain line: P which connects the center of the movable cover 70, and one (92) of circumferentially opposite ends 92, 94 of the outer window 84, which is located rearwardly of the other end 94, as viewed in the clockwise direction of the bottom wall 78.

The stationary cover 68 as described above is bonded at the lower end face of the cylindrical portion 72 to the outer peripheral portion of the lid 26, as shown in FIG. 9, such that the inner window 74 corresponds to or is aligned with the spout 33 of the tube 36 mounted on the lid 26. Then, the movable cover 70 is provided on the outer surface of the stationary cover 68, such that the rotary pin 80 is inserted through the through hole 86 formed at the center of the bottom wall 76 of the stationary cover 68, and such that the engaging pin 90 is inserted through one of the recesses 88, 89 of the inner window 74.

In this manner, the stationary cover 68 is fixed to the lid 26 so as to cover the upper surface of the lid 26 such that the spout 33 of the tube 36 is exposed outside through the inner window 74. The movable cover 70 provided on the stationary cover 68 is rotatable about the rotary pin 80 relative to the stationary cover 68. The angle of the rotation of the movable cover 70 relative to the stationary cover 68 is determined by engagement of the engaging pin 90 with the two recesses 88, 89 formed at the circumferential ends of the inner window 74. That is, the engaging pin 90 is moved along the circumferential edge 75 of the bottom wall 76 while the movable cover 70 is rotated about the rotary pin 80 relative to the stationary cover 68. With the movable cover 70 thus positioned with respect to the stationary cover 68, the ball-like stopper 81 is located inside the bottom wall 76 of the stationary cover 68. When the table pot 22 is tilted, therefore, the stopper 81 engages at its outer periphery with a portion of the inner surface of the bottom wall 76 which defines the through hole 86, whereby the movable cover 70 is prevented from being detached from the stationary cover 68.

Figure 14:
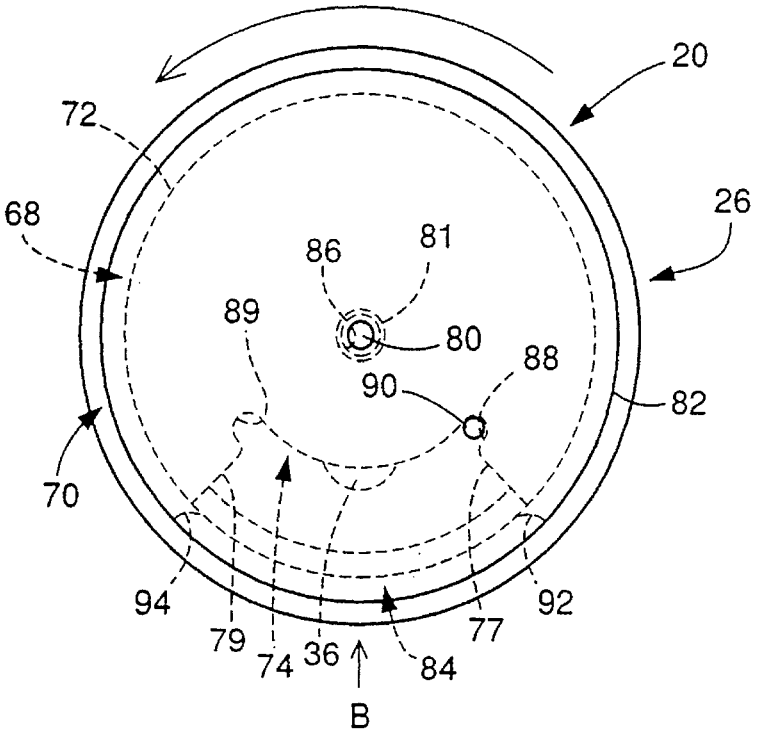
FIG. 14 is a view showing the stationary cover and movable cover of the table pot of FIG. 9 when placed in their open position, as viewed in the direction of an arrow A in FIG. 9.
Figure 15:
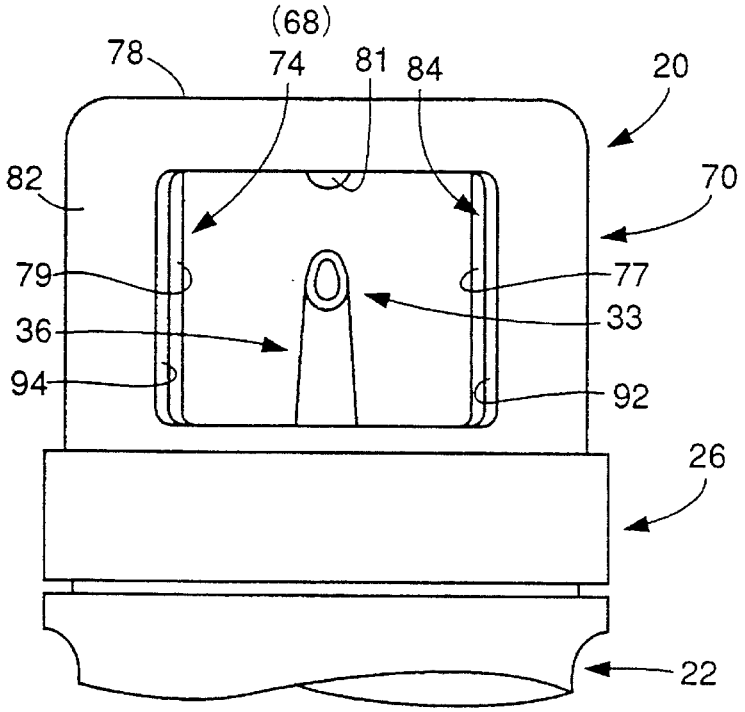
FIG. 15 is a view showing an upper portion of the table pot of FIG. 9, as viewed in the direction of an arrow B in FIG. 14.

When the movable cover 70 is rotated relative to the stationary cover 68, in the counterclockwise direction (in the direction of the arrow in FIG. 14), as shown in FIG. 14, the engaging pin 90 is brought into engagement with the recess 88 located rearwardly of the other recess 89 as viewed in the clockwise direction of the bottom wall 76, whereby the corresponding circumferential ends 77, 92 of the inner and outer windows 74, 84 are aligned with each other, that is, the inner and outer windows 74, 84 are aligned with each other, as shown in FIG. 15. Thus, the spout 33 of the tube 36 is exposed outside through these windows 74, 84. With the engaging pin 90 held in engagement with the recess 88, the movable cover 70 is inhibited from rotating relative to the stationary cover 68.

Figure 16:
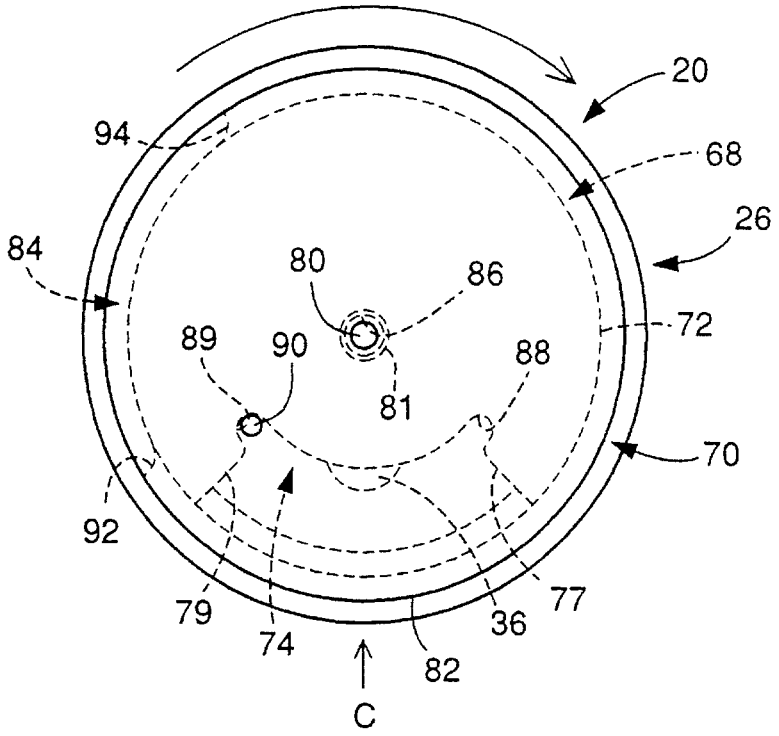
FIG. 16 is a view showing the stationary cover and movable cover of the table pot of FIG. 9 when placed in their closed position, as viewed in the direction of the arrow A in FIG. 9.
Figure 17:
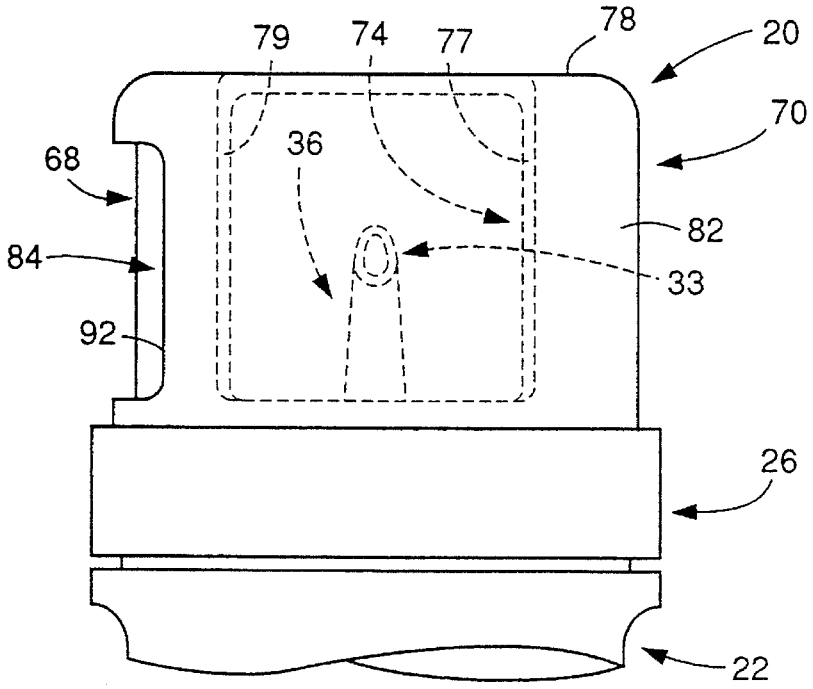
FIG. 17 is a view showing an upper portion of the table pot of FIG. 9, as viewed in the direction of an arrow C in FIG. 16.

When the movable cover 70 is rotated relative to the stationary cover 68, in the clockwise direction (in the direction of the arrow in FIG. 16), as shown in FIG. 16, the engaging pin 90 is brought into engagement with the recess 89 located frontwardly of the recess 88 as viewed in the clockwise direction of the bottom wall 76, whereby the circumferential end 92 of the outer window 84 of the movable cover 70 is located ahead of the circumferential end 79 (opposite to the circumferential end 77) of the inner window 74 of the stationary cover 68, in the clockwise direction of the bottom wall 72. Thus, the inner window 74 is covered with the cylindrical portion 82 of the movable cover 70. As a result, the inner window 74 of the stationary cover 68 is closed, as shown in FIG. 17, and the spout 33 of the tube 36 is covered with the stationary cover 68 and the movable cover 70, and thus hygienically protected. When the covers 68, 70 are placed in this closed position, the movable cover 70 is inhibited from rotating relative to the stationary cover 68.

It will be understood from the above description that the recesses 88, 89 and the engaging pin 90 constitute a first and a second engaging portion of the movable and stationary covers 68, 70, respectively.

In the table pot 20 of the instant embodiment, the inner window 74 of the stationary cover 68 can be easily closed and opened only by rotating the movable cover 70 relative to the stationary cover 68, in the clockwise and counterclockwise directions. Accordingly, the spout 33 formed at the distal end of the tube 36, through which the liquid seasoning is delivered out of the table pot 20, can be easily covered with the stationary cover 68 and movable cover 70, or exposed to the outside of the pot 20.

Further, in the instant embodiment, the movable cover 70 is not pivoted about an axis which extends in the transverse or horizontal direction of the table pot 20, but is rotated about the rotary pin 80 extending in the axial direction of the pot 20, so as to selectively open and close the inner window 74. Accordingly, the movable cover 70 is prevented from closing due to its own weight, when the table pot 20 is tilted to dispense the liquid seasoning, thus eliminating a need to make sure that the inner window 74 is completely open, or provide a member for holding the movable member 70 in its open position.

As described above, in the table pot 20 of the present embodiment, the spout 33 can be easily exposed to the outside of the table pot 20, without requiring any cumbersome procedure and special attention. Further, the spout 33 is surely kept exposed outside, that is, the movable cover 70 is kept open without fail, when the table pot 20 is tilted to dispense the liquid seasoning. In this case, the liquid seasoning will not be dispensed inside the movable cover 70 or scattered by the cover 70, and the table pot 20 and its surroundings will not be contaminated by the liquid seasoning, thus assuring improved ease and efficiency in using the table pot 20.

The rotation of the movable cover 70 relative to the stationary cover 68 is inhibited by engagement of the engaging pin 90 with the two recesses 88, 89 formed at the circumferentially opposite ends of the inner window 74 of the stationary cover 68. Therefore, the movable cover 70 can be selectively placed in its open and closed positions with high efficiency, without requiring cumbersome positioning of these two covers 68, 70 relative to each other. This also increases easiness of using the present table pot 20.

While the present invention has been described in its presently preferred embodiments, for illustrative purpose only, it is to be understood that the invention may be otherwise embodied.

For example, the length, cross sectional shape and other features of the extended air passage (inner bore) are not limited to those of the illustrated embodiments, but may be suitably determined depending upon the viscosity of the liquid seasoning to be contained, for example.

In the illustrated embodiments, the mounting hole 32 receiving the tube 36 and the air inlet hole 34 are both formed through the top plate 30 of the lid 26, in the vertical direction of the table pot 20. However, these holes may be formed transversely or obliquely through the side wall of the lid 26.

Figure 7:
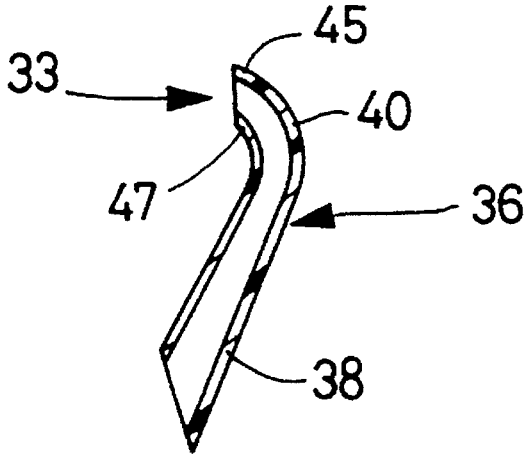
FIG. 7 is a view showing in enlargement another example of a spout of the table pot of FIG. 1.
Figure 8:
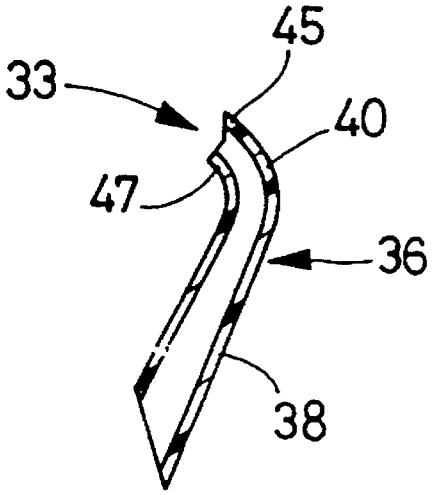
FIG. 8 is a view showing in enlargement a further example of a spout of the table pot of FIG. 1.

In the illustrated embodiments, the opening of the spout 33 formed at the upper end of the tube 36 is defined by the concave end face of the curved portion 40 of the tube 36. Further, the upper end 45 of the spout 33 protrudes a larger distance than the lower end 47, in the direction in which the liquid seasoning is delivered out of the table pot 20. However, the shape of the opening of the spout 33 is not limited to that of the illustrated embodiments, but may be changed provided the upper end 45 protrudes forward in the direction of flow of the liquid seasoning, by a larger distance than the lower end 47. For example, the opening of the spout 33 may be defined by an inclined or slant end face of the tube 36 as shown in FIG. 7, or a curved end face of the tube 36 as shown in FIG. 8.

The shielding member is only required to be located below the opening of the inner bore 56 of the cylindrical body 52. That is, the shielding member does not need to extend up to the lid 26 on the side of the spout. Further, the outer flange 54 does not need to be formed over the entire circumference of the opening of the inner bore 56, but may be formed along a circumferential portion thereof.

The shape of the shielding member should be determined, taking account of the viscosity of the liquid seasoning to be contained in the table pot 20, for example. More specifically, when the liquid seasoning having a relatively small viscosity is used, the through hole 66 of the shielding member 64 may be reduced in size or closed, or a pocket-like shielding member may be provided by covering the spacing between the opposite sides of the lower part of the cover plate 58 and the outer flange 54 of the cylindrical body 52, so that bubbles are likely to remain around the opening of the extended air passage.

The shape of the shielding member is not limited to that of the illustrated embodiments, but may be changed such that the whole shielding member is formed integrally with the opening of the inner bore 56 of the cylindrical body 52.

Moreover, the stationary and movable covers 35, 39 provided on the lid 26 may be eliminated.

It is also to be understood that the present invention may be embodied with various other changes, modifications and improvements, which may occur to those skilled in the art, without departing from the scope of the invention as defined in the following claims.

What is claimed is:

1. A table pot for a liquid seasoning, comprising:

a container body having an opening at an upper end thereof, for storing the liquid seasoning therein;

a lid which is attached to said container body so as to close said opening, said lid having a fluid passage and an air inlet formed in an outer peripheral portion thereof such that the fluid passage and the air inlet are located diametrically opposite to each other;

means for defining an extended air passage which is connected to an inner open end of said air inlet and has a larger cross sectional area than said air inlet, said extended air passage extending toward said fluid passage while being inclined downwardly of said lid; and a shielding member located below an opening of said extended air passage remote from said air inlet, so as to interfere with flow of bubbles of air from said opening of said extended air passage into the liquid seasoning.

2. A table pot according to claim 1, wherein said shielding member comprises an outer flange which extends radially outwards from said opening of said extended air passage, and a cover plate which extends upwards and obliquely from a lower peripheral portion of said outer flange toward said fluid passage, said cover plate covering said opening of said extended air passage with a spacing therebetween.

3. A table pot according to claim 2, wherein said outer flange is formed over an entire circumference of said opening of said extended air passage.

4. A table pot according to claim 1, wherein said shielding member has a through hole formed at a lower portion thereof.

5. A table pot according to claim 1, wherein said lid has a top plate having diametrically opposite circumferential portions, and said fluid passage is formed by a tube which extends upwards from one of said diametrically opposite, circumferential portions of said top plate, while said air inlet comprises a through hole formed through the other of the diametrically opposite, circumferential portions of the top plate.

6. A table pot according to claim 5, wherein said tube has an integrally formed, extended portion which extends downwards from said one of said diametrically opposite, circumferential portions of said top plate, into said container body.

7. A table pot according to claim 1, wherein said means for defining an extended air passage comprises a cylindrical body having an opening at one axial end thereof and a bottom wall at the other axial end, said cylindrical body being fixed on the side of said bottom wall to said lid, such that said cylindrical body extends in a radial direction of said lid while being inclined downwardly of the lid.

8. A table pot according to claim 1, wherein said fluid passage is formed by a tube which extends upwards from said lid and has a spout at an upper open end thereof, said spout having an upper end and a lower end which defines an opening therebetween, said upper end protruding a larger distance than said lower end, in a direction in which the liquid seasoning flows from said container body.

9. A table pot according to claim 8, wherein said opening of said spout is defined by a concave end face of said tube as viewed in said direction in which the liquid seasoning flows from said container body.

10. A table pot according to claim 1, wherein said fluid passage is formed by a tube which extends upwards from said lid and has a spout at an upper open end thereof, said table pot further comprising a stationary cover having a circular cross section for covering an upper surface of said lid, and a movable cover having a circular cross section and a larger size than said stationary cover, for covering said stationary cover such that said movable cover is rotatable relative to the stationary cover, said stationary cover having an inner window formed through a cylindrical wall thereof, said spout of said tube being exposed externally through said inner window, said movable cover having an outer window formed through a cylindrical wall thereof, said movable cover being rotated relative to said stationary cover and being selectively placed in an open position in which said inner and outer windows are aligned with each other so that said spout is exposed outside, and in a closed position in which said inner window is covered by said cylindrical wall of said movable cover.

11. A table pot according to claim 10, wherein said stationary cover and said movable cover have a first engaging portion and a second engaging portion, respectively, said first and second engaging portions being held in engagement with each other when said movable cover is placed in said open position and said closed position, so as to inhibit the movable cover from rotating relative to the stationary cover.

* * * * *